US005192154A

United States Patent [19]

Moeck

[11] Patent Number: 5,192,154

[45] Date of Patent: Mar. 9, 1993

[54] APPLICATOR INSERT FOR AN APPLICATOR IMPLEMENT

[75] Inventor: Gerhard Moeck, Kirchehrenbach, Fed. Rep. of Germany

[73] Assignee: Schwan-Stabilo Schwanhaeusser GmbH & Co, Nuremberg, Fed. Rep. of Germany

[21] Appl. No.: 696,213

[22] Filed: May 6, 1991

[30] Foreign Application Priority Data

Jun. 15, 1990 [EP] European Pat. Off. ..... 90111302.7

[51] Int. Cl.[5] ..... B43K 3/00; B43K 8/02

[52] U.S. Cl. ..... 401/198; 401/207; 401/54

[58] Field of Search ..... 401/54, 196, 198, 199, 401/207, 205, 206

[56] References Cited

U.S. PATENT DOCUMENTS

| | | | |
|---|---|---|---|
| 1,223,996 | 4/1917 | Mather | 401/198 X |
| 2,549,227 | 4/1951 | Ostrander | 401/198 |
| 3,345,674 | 10/1967 | Graft | 401/198 |
| 3,355,239 | 11/1967 | Albrecht | 401/198 X |
| 3,377,124 | 4/1968 | Matsumoto | 401/198 |
| 4,238,162 | 12/1980 | Sherwood | 401/198 |
| 4,302,120 | 11/1981 | Ligouri | 401/198 |
| 4,357,117 | 11/1982 | Nagai | 401/199 X |
| 4,761,090 | 8/1988 | Goh | 401/54 X |

FOREIGN PATENT DOCUMENTS

| | | |
|---|---|---|
| 1458417 | 10/1966 | France . |
| 1479022 | 3/1967 | France . |
| 2253636 | 7/1975 | France . |
| 746815 | 3/1956 | United Kingdom . |
| 2150506 | 7/1985 | United Kingdom . |

*Primary Examiner*—Danton D. DeMille
*Attorney, Agent, or Firm*—Bachman & LaPointe

[57] ABSTRACT

An applicator insert for an applicator implement comprises an applicator member with capillary spaces, which is slidably accommodated in a holder in the form of a tubular sleeve. The sleeve has a front end portion of an internal cross-section which matches the applicator member to guide same and a rearward end portion of an internal cross-section which is larger than the cross-section of the applicator member. Disposed in the space between the rearward sleeve portion and the applicator member is a spring element having its front end portion fixed with respect to the applicator member and its rear end portion fixed with respect to the rearward sleeve portion, whereby the applicator member is sprung in relation to the sleeve.

9 Claims, 2 Drawing Sheets 10
12,14
16
18
20
22
24
26
28
30,32
34
36
38
40
42
44
46
48
50
52
54
56
58

APPLICATOR INSERT FOR AN APPLICATOR IMPLEMENT

BACKGROUND OF THE INVENTION

The present invention generally concerns an implement for making marks on a surface or material or for applying a medium to a surface or material, such as a writing implement, drawing implement, marking implement or applicator implement. For the sake of convenience hereinafter such an implement will be referred to broadly as an applicator implement.

A typical applicator implement comprises a body portion into which is fitted an applicator insert. The applicator insert may comprise an applicator member having capillary spaces for the feed of the medium such as ink to be applied. The applicator insert further includes a holder comprising a tubular sleeve consisting of a front end portion of an internal cross-section which is suited to the applicator member. The applicator member projects out of the front end of the sleeve with an applicator portion, while at the rear end it has a feed portion for feeding a medium to be applied from the body of the applicator implement to the applicator portion of the applicator member.

The applicator member may be in various configurations comprising for example sintered porous material with a capillary action, laminar fiber material which is consolidated by means of a suitable process, extruded material with a capillary action, and the like. An applicator member of that kind may be used in particular as what is known as a fine liner with a diameter of around 0.5 mm. When the applicator member is in the form of a fine liner of that kind, the front edge of the front end portion of the sleeve is rolled inwardly towards the applicator member which is disposed therein in order to produce a mechanically fixed connection between the sleeve of the holder and the applicator member accommodated therewithin. However that rolled-in configuration at the front edge of the sleeve of the holder results in the applicator member suffering from a notch effect which can have an adverse effect on the flow of ink or like medium through the capillary spaces of the applicator member, for the reason that the front edge of the sleeve is only at a relatively small spacing from the tip of the applicator portion of the applicator member, where it projects from the sleeve. Particularly in the case of fine liner implements of a diameter of around 0.5 mm, when there is a rigid connection between the applicator member and the sleeve, the tip of the applicator member, on the free end of the applicator portion thereof where it projects out of the sleeve, often suffers from bending or snapping off so that the implement is then rendered useless. Likewise, when the writing member is rigidly fixed to the sleeve of the holder, if the implement is not used precisely in the proper fashion, the applicator member of the implement may suffer from the tip thereof becoming splayed or fanned out, which once again makes the implement useless. If on the other hand the mechanical fixing effect between the sleeve of the holder and the applicator member is not sufficiently firm, it may happen that, when an application pressure is applied to the implement, the applicator member may be pressed back into the sleeve, once again with the result that the implement is rendered useless.

SUMMARY OF THE INVENTION

An object of the present invention is to provide an applicator insert for an applicator implement, in which damage to or serious deterioration of the applicator tip can be substantially avoided using simple means.

Another object of the present invention is to provide an applicator insert for an applicator implement, which is capable of providing a better feel when using the applicator implement.

Still another object of the present invention is to provide an applicator insert for an applicator member which can provide a more uniform flow of ink than previous designs.

In accordance with the principles of the present invention, these and other objects are attained by an applicator insert for an applicator implement, comprising an applicator member accommodated in a holder comprising a tubular sleeve provided with a front end portion of an internal cross-section which is adapted to the applicator member, with the applicator member projecting from the sleeve at the front end thereof to provide an applicator portion while the rear end of the applicator member projects from the sleeve to provide a feed portion for feeding ink or like medium to the applicator portion. The sleeve further includes a rearward sleeve portion of an internal cross-section which is larger than the cross-section of the applicator member, whereby a space is defined between the applicator member and the rearward sleeve portion. Disposed in the space is a spring means having a front end portion and a rear end portion. The front end portion of the spring means is fixed with respect to the applicator member by means of a ring element which is disposed on the applicator member and with which the front end portion of the spring means co-operates while the rear end portion of the spring means is fixed with respect to the rearward sleeve portion, thereby to provide for resilient displaceability of the applicator member with respect to the sleeve. The ring element is such that in a non-loaded rest condition it can be pushed on to the applicator member and in the fixing condition is clamped against the outside peripheral surface of the applicator member with a defined clamping force which does not interrupt or seriously impair the capillary spaces in the applicator member.

As will be seen in greater detail hereinafter, in comparison with the applicator member, the sleeve is of an only comparatively short axial length, while the applicator member, in particular in the form of what is known as a fine liner, projects with its front end portion providing the applicator portion thereof out of the sleeve to a relatively short extent, while its rearward end portion projects out of the sleeve at the rearward end thereof to a relatively long extent. The rewarward feed portion of the applicator member is preferably of an axial or longitudinal extent which is many times greater than the axial longitudinal dimension of the sleeve. By virtue of the fact that the spring means which is disposed in the space between the sleeve and the applicator member is fixed to the applicator member by way of its front end portion at a relatively great axial spacing from the applicator tip, the above-mentioned notch effect is at an appropriate position by virtue of being a relatively great distance from the applicator tip and can be readily controlled as the holding force which can result in a reduction in the flow of ink past the notch configuration can be less than when the applicator insert involves a fixed connection between the applicator member and the sleeve of the holder, as discussed above. The configuration of the present invention provides that the applicator member is fixed at a different location and with a lower degree of intensity than in the above-discussed prior implements, so that not only is the flow of ink impeded to a lesser degree, but the risk of the applicator tip of the applicator member being bent or snapped off is advantageously reduced. The arrangement of the invention also provides the advantage that the applicator member enjoys a good linear guidance effect in regard to its movement within the sleeve, by virtue of the front end portion of the sleeve co-operating with the applicator member, so that the applicator member is resiliently movable within the sleeve and thus in relation to the body of the applicator implement in which the applicator insert is fitted, to accommodate substantial pressures between the applicator member and the surface to which it is applied for application purposes. That is particularly advantageous in relation to fine liner implements of a diameter of around 0.5 mm. It will be appreciated however that the principle according to the invention may also be employed in relation to applicator members of a larger diameter of up to around 2 mm and greater.

The above-mentioned ring element may be of a simple flat configuration and comprise a relatively soft material or it may be for example of a dished configuration and comprise a plastically yielding material. The ring element may also be of a rivet-like configuration or the like and may be secured to the applicator member by a peening or crimping operation. With an applicator insert of that configuration, in a first operation for producing the applicator insert, the ring element may be easily fitted on to the applicator member and then fixedly clamped in position to the outside peripheral surface of the applicator member at a predetermined spacing from the applicator tip thereof. The spring means in the form of a tubular spring element for example is then pushed on to the applicator member from the rearward end thereof until it comes to bear against the ring element, with its front end portion. The sleeve of the holder is then fitted on to the applicator member from the front end thereof. Instead of a dished ring element, as already indicated above, it is also possible to use a ring of a relatively soft material which is compressed to crimp it on to the applicator member, or the element may be in the form of a sleeve-like or rivet-like component which is secured on the applicator member by being rolled in or crimped thereto.

Preferably, the spring means is secured with respect to the sleeve at its rearward end portion against a support shoulder provided at the rearward sleeve portion. The support shoulder may be formed by an inwardly turned edge portion of the sleeve at the rearward end thereof. That provides an applicator insert of a simple configuration in which the sleeve with the spring means takes up only a very small amount of space on the applicator member. That can be a matter of advantage in particular in regard to the fine liners as already referred to above.

In a preferred feature the ring element for fixing the front end portion of the spring means on the applicator member comprises a metal, while the sleeve surrounding the spring means may comprise for example stainless steel or a suitable plastic material.

Preferably the spring means is in the form of a tubular sleeve comprising a resiliently yielding plastic material. The tubular sleeve may be provided for example with holes, ribs, slots or the like, as required. It is also possible for the spring means to comprise a compression coil spring consisting of a suitable wire or strip material.

Particularly when the applicator implement is in the form of a fine liner, it may be advantageous for the applicator member to comprise a plastic material which has a central region forming the capillary spaces and a peripheral sealing casing portion which surrounds the central region to provide a sealing effect therearound. An applicator member of that kind is known so that there is no need to discuss same in greater detail herein. It would also be possible for the applicator member to be made from a fiber or wick material.

As an applicator implement with an applicator member in accordance with the invention normally uses an impregnated fiber member as a storage means for the application medium such as ink, to provide a fluid communication between the fiber member and the applicator member, the applicator member may advantageously have a rearward end portion from which the above-mentioned casing portion which sealingly encloses the central region forming the capillary spaces is at least partially removed. That end portion may be of a reduced configuration, for example, towards the rearward end of the applicator member. In order to avoid intermediate spaces occurring between the rearward end portion of the applicator member and the impregnated fiber member of the implement, which would be undesirable, having regard to the resilient mounting of the applicator member within its holder sleeve, it is advantageous for the rearward end portion of the applicator member to be provided with a side surface which is oriented in parallel relationship with the longitudinal center line of the applicator member. Such a configuration for the rearward end portion of the applicator member can prevent the occurrence of intermediate spaces between the fiber member for storing the application medium and the resiliently yielding applicator member, so as always to provide for a uniform flow of ink from the fiber member storing the ink to the applicator member.

Further objects, features and advantages of the present invention will be apparent from the following description of preferred embodiments thereof.

DESCRIPTION OF PREFERRED EMBODIMENTS

Before describing the specific preferred embodiments it will be noted that the structures shown in FIGS. 1 through 5 are illustrated on different scales but all considerably enlarged, in order more clearly to show the features of the applicator insert according to the invention.

Figures 1, 2, 3:
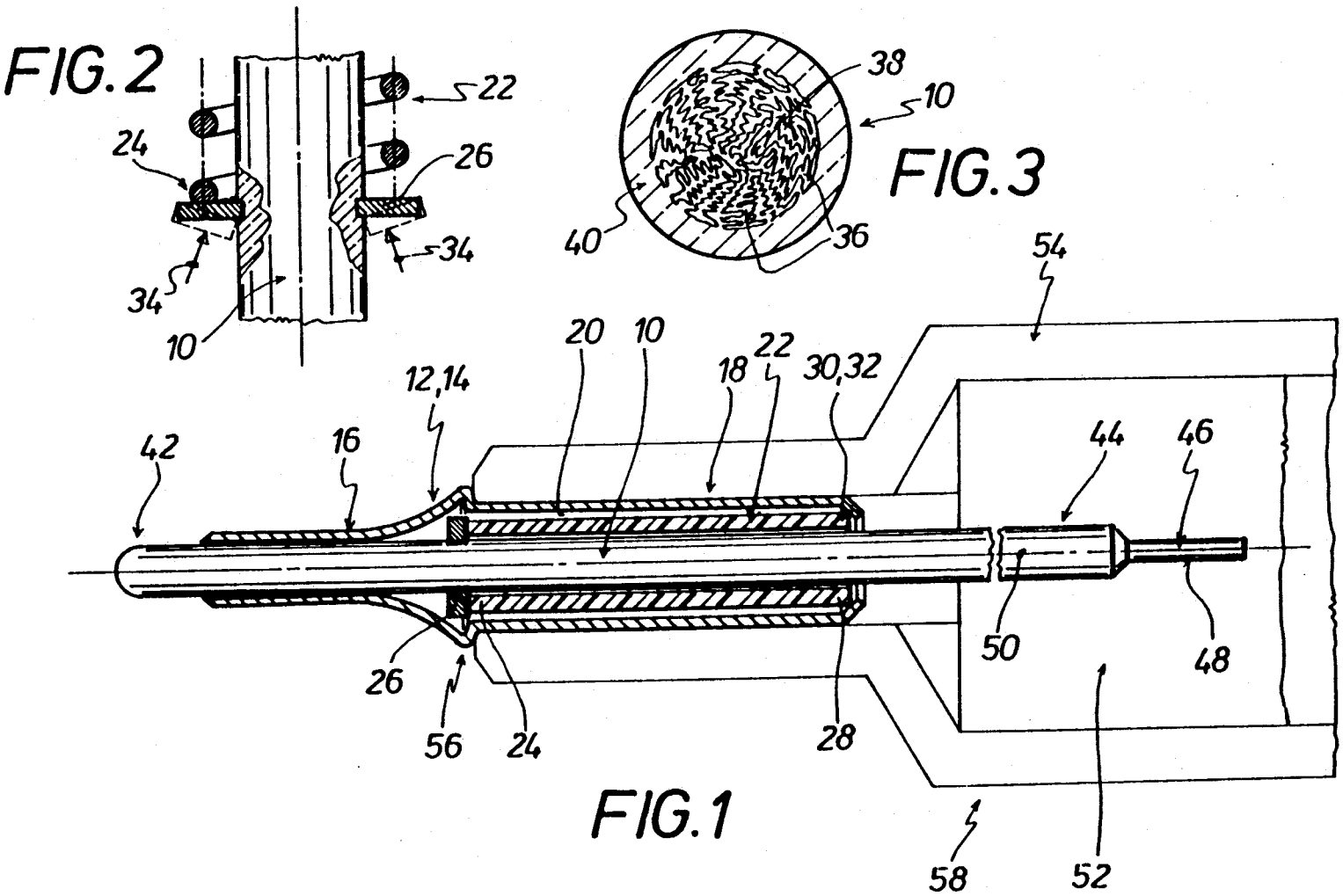
FIG. 1 is a view in longitudinal section through an applicator insert in its position of being fitted into an applicator implement which is shown in thin lines.
FIG. 2 is a partly sectional view of part of the front end portion of the applicator member with a modified form of a spring element.
FIG. 3 is a view in cross-section through the applicator member of FIGS. 1 and 2.

Referring therefore now to FIG. 1, shown therein is an applicator insert which may be for example an insert for a fine liner implement for writing, drawing, marking or other application purposes. The applicator insert comprises an applicator member 10 and a holder 12 comprising a generally tubular sleeve 14. The sleeve 14 has a front end portion 16 and a rearward sleeve portion 18. The front end portion 16 of the sleeve 14 is of internal dimensions which are adapted to the cross-sectional dimensions of the applicator member 10 so that the front end portion 16 of the sleeve 14 is capable of providing a guiding action for the applicator member 10.

The rearward sleeve portion 18 is of an internal cross-section which is larger than the cross-sectional dimensions of the applicator member 10 whereby an intermediate space 20 of generally annular configuration is defined between the outside surface of the applicator member 10 and the inside surface of the rearward sleeve portion 18. The annular space 20 serves to accommodate a spring element 22 which is shown in the form of a generally tubular sleeve and which is fixed to the applicator member 10 at the front end portion 24 of the spring element 22 by means of a ring element 26 which is suitably disposed on the applicator member 10. The spring element 22 has a rearward end portion indicated at 28 which is secured with respect to the sleeve 14 at the rearward sleeve portion 18 thereof, more specifically by bearing against a support shoulder 30 formed at the rearward end of the sleeve 14. More specifically the support shoulder 30 is an inwardly turned edge portion 32 at the rearward end of the rearward sleeve portion 18 of the sleeve 14.

As mentioned above, FIG. 1 shows the spring element 22 in the form of a tubular sleeve comprising a suitable resiliently yielding plastic material. It will be seen that the spring element 22 is arranged coaxially with respect to the applicator member 10.

As an alternative to the spring element 22 being in the form of a tubular sleeve, FIG. 2 shows a part of a spring element 22 which is in the form of a compression coil spring comprising a suitable wire material. Reference numeral 26 in FIG. 2 also identifies the ring element with which the spring element 22 is secured to the applicator member 10, by means of the front end portion 24 of the spring element 22. In FIG. 2, the ring element 26 is shown by means of thin broken lines in its original condition in which the ring element 26 is of a dished or indented configuration. When the ring element 26 has been fitted on to the applicator member 10 at the appropriate position, a force is applied to the ring element 26 in the direction indicated by the arrows 34 in FIG. 2, thus resulting in a reduction in the inside diameter of the ring element 26 as a result of its moving out of its dished configuration shown in broken lines in FIG. 2 into a substantially flat configuration as shown in solid lines in FIG. 2. In that way the ring element 26 is fixedly clamped on the applicator member 10. The clamping action is defined in such a way that the flow of ink or other application medium through the applicator member 10 is not seriously impaired thereby.

Reference will now be made to FIG. 3 which shows a view in cross-section on a greatly enlarged scale through the applicator member 10, illustrating that the applicator member 10 comprises a central region 38 forming capillary spaces 36, and a sealing peripheral casing portion 40 which surrounds the central region 38 to provide a sealing effect therearound.

Reference will now again be made to FIG. 1 showing that the applicator member 10 has an applicator portion which projects out of the sleeve 14 at the front end thereof, to provide an applicator tip indicated at 42. It will also be seen from FIG. 1 that the applicator member 10 projects out of the sleeve 14 at the rearward end thereof to provide a duct or feed portion 44, the interruption therein indicating in the usual way that the feed portion 44 is of greater length than that illustrated in FIG. 1. The portion 44 has a rearward end portion 46 from which the sealing casing portion indicated at 40 in FIG. 3 is at least partially removed, thereby reducing the transverse dimension of the end portion 46 of the feed portion 44. The rearward end portion 46 of the applicator member 10 advantageously provides a cylindrical peripheral surface as indicated at 48, that is to say, it has a side surface which extends in parallel relationship to a longitudinal center line of the applicator member 10, as indicated at 50 in FIG. 1. That configuration avoids the formation of a gap between the applicator member 10 or more specifically the rearward end portion 46 thereof, and a storage member 52 of which a part is shown in FIG. 1, for example being of fiber material, for storage of the application medium such as ink; thus, if the applicator member 10 moves axially relative to the sleeve 14 as a result of pressure applied to the applicator member 10 during for example a writing operation, the rearward end portion 46 of the applicator member 10 still remains in fluid communication with the ink storage member 52.

Reference numeral 54 in FIG. 1 illustrates a part of the casing of the applicator implement, as shown in thin lines.

The procedure for the production of an applicator implement of the above-indicated kind is for example as follows:

In a first working operation the ring element 26 is fitted on to the applicator member 10 and located at the appropriate position thereon. A force as indicated by the arrows 34 in FIG. 2 is then applied substantially axially to the ring element 26, thereby to fix the ring element 26 in its position on the applicator member 10. In the next working operation, the spring element 22 is fitted on to the applicator member 10 from the end at the rearward end portion 46 thereof, until the front end portion 24 of the spring element 22 lies against the ring element 26 which has already been fixed on the applicator member 10. Thereupon, the sleeve 14 is fitted on to the applicator member 10 from the end with the applicator tip 42 thereof, until a transitional portion 56 of the sleeve which provides a support shoulder thereon between the front end portion 16 of the sleeve 14 and the rearward sleeve portion 18 is disposed in the vicinity of the ring element 26. That relationship can be clearly seen from FIG. 1. The rearward edge portion 32 of the sleeve 14 or of the rearward sleeve portion 18 is then flanged over inwardly so that the spring element 22 is supported against the ring element 26 by means of its front end portion 24 while the rearward end portion 28 of the spring 22 bears against the inwardly flanged edge portion 32 of the rearward portion 18 of the sleeve 14. In that way the spring element 22 is fixed in a precisely defined position between the sleeve 14 and the applicator member 10. The way in which the spring element 22 is fixed in position within the sleeve 14 means that the spring element 22 is mechanically unstressed in the non-loaded rest position of the applicator member 10.

The applicator member 10 together with the sleeve 14, after the above-discussed assembly operations, can then be inserted as an applicator insert into the casing 54 of an applicator implement. When the applicator tip 42 of the insert fitted into the implement 58 is pressed against a surface for example for writing or drawing, then, with the sleeve 14 remaining stationary in the applicator implement casing 54, the applicator member 10 can move axially into the casing 54, with the spring element 22 being mechanically stressed as a result, more specifically by being compressed between the ring element 26 and the rearward inwardly turned edge 32 of the sleeve 14. When the application pressure applied to the applicator tip 42 ceases, the spring element 22 can return to its rest position so that the applicator tip 42 moves again in a direction outwardly of the casing 54. That construction thus provides a resiliently supported applicator member 10 which thus provides a good springy feel in use thereof. The illustrated configuration also provides for a uniform flow of ink or other application material, and an excellent degree of safeguard against breakage of the applicator portion of the applicator member 10.

Figure 4:
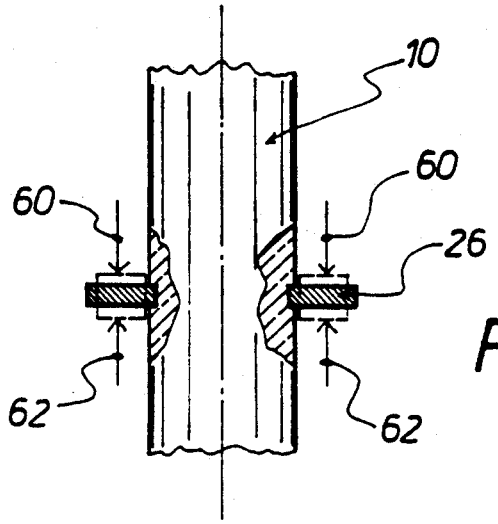
FIG. 4 is a view similar to that shown in FIG. 2 showing a portion of the applicator member in another embodiment of the applicator insert.

Referring now to FIG. 4, shown therein on a greatly enlarged scale is a part of an applicator member 10 carrying a ring element 26 which is shown in its initial or original condition in thin broken lines while it is shown in normal lines and with hatching in its operative condition in which it is fixed to the applicator member 10. The ring element 26 in this construction is in the form of a simple flat ring which preferably comprises a relatively soft, plastically deformable material. In order for the ring element 26 to be secured to the applicator member 10 by a crimping action, the applicator tip portion indicated at 42 in FIG. 1 is introduced into a suitable mounting. The ring element 26 is then fitted on to the applicator member 10 from the rearward end portion of the applicator member 10. A force as indicated by an arrow 60 is then applied to the ring element 26, for example using a hammer of a ring-like configuration which is fitted over the applicator member 10 and then struck against the ring element 26. The reaction force applied to the ring element 26 by the above-mentioned mounting (not shown) is indicated by the arrows 62. The forces 60, 62 cause the ring element 26 to be compressed so that it is reduced in diameter and at the same time increased in regard to its radial dimensions so that, with the ring element 26 being of suitable dimensioning, it is crimped on to the applicator member 10 without impairing the capillary performance thereof.

Figure 5:
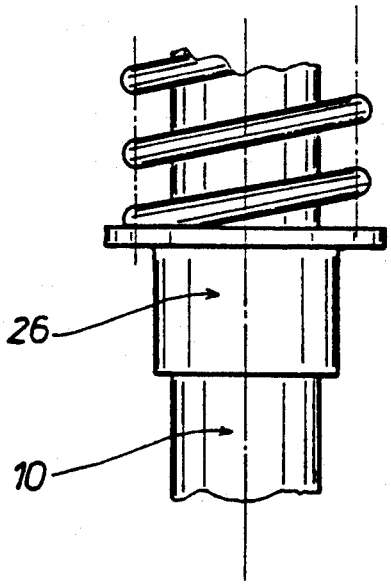
FIG. 5 is a view similar to those shown in FIGS. 2 and 4 showing a portion of the applicator member in yet another embodiment.

FIG. 5 is a view on an enlarged scale of part of an embodiment of the applicator member 10 carrying a ring element 26 which is in the general configuration of a hollow rivet. The ring element 26 can be fixed to the applicator member 10 by a crimping or flanging operation without adversely affecting the capillary action of the applicator member 10.

It will be appreciated from the foregoing that the applicator insert according to the invention has the advantage of providing a resilient or springy feel when used for for example writing or drawing, by virtue of the applicator member 10 being sprung in relation to the sleeve 14 of the holder 12. The applicator insert of the invention further affords the advantage that the writing member is protected from breakage or splaying as a result of its resiliently yielding mounting. The applicator insert with its spring action is also of a compact construction and is superior to a writing implement as disclosed in German Utility Model No 19 37 226 having a wick forming the writing member, with the wick being resiliently displaceably carried in the casing of the applicator implement. That implement involves the use of a spring element with a spring constant of between 50 and 600 g/cm, but the spring element is disposed between an end closure cap and the rearward face of a storage member for storing the ink, which is disposed in the casing of the implement. However that construction is not comparable to the implement and insert in accordance with the principles of the present invention, beyond the general aspect of providing a spring mounting for the applicator member.

It will be appreciated that the foregoing constructions according to the principles of the present invention have been set forth solely by way of example and illustration thereof and that various modifications and alterations may be made therein without thereby departing from the spirit and scope of the invention.

What is claimed is:

1. An applicator insert for an applicator implement comprising: a fine liner applicator member having a diameter of from about 0.5 to 2 mm and having capillary spaces and having a front end portion providing an applicator portion and a rearward end portion providing a feed portion for feeding application medium to the applicator member; a holding means accommodating the applicator member and having a continuous, single, unitary, tubular sleeve adjacent the applicator member including a front end portion of an internal cross-section adapted to the applicator member, with the applicator portion of the applicator member projecting from the sleeve at the front end portion thereof, and the sleeve including a rearward sleeve portion from which said feed portion projects and which is of an internal cross-section larger than the cross-section of applicator member so that an intermediate space is provided between the rearward sleeve portion and the applicator member, said rearward sleeve portion including a support shoulder means formed by an edge portion of said rearward sleeve portion, said edge portion being turned over inwardly of the sleeve; a spring means disposed in said space and having a front end portion and a rear end portion which is fixed with respect to the rearward sleeve portion, wherein said spring means is supported with its rear end portion against said support shoulder means and wherein said spring means is a tubular sleeve comprising a resiliently yielding plastic material; and a ring element on the applicator member and co-operating with said front end portion of said spring means to fix same with respect to the applicator member to provide for resilient displaceability of the applicator member with respect to the sleeve, the ring element being adapted in a non-loaded condition to be fitted on to the applicator member and in the fixing condition being clamped against the outside peripheral surface of the applicator member with a defined clamping force which does not interfere with said capillary spaces.

2. An insert as set forth in claim 1 wherein said applicator member comprises a plastic material and comprises a central region providing said capillary spaces and a peripheral sealing portion which encloses the central region to provide a sealing effect therearound.

3. An insert as set forth in claim 2 wherein said applicator member has a rearward end part from which said peripheral portion is at least partially removed.

4. An insert as set forth in claim 3 wherein said rearward end part of said applicator member has a side surface which is oriented in parallel relationship with the longitudinal center line of the applicator member.

5. An insert according to claim 1 wherein the holding means includes a transitional portion between front end portion thereof and the rearward sleeve portion thereof of larger cross-section than said front end portion and rearward sleeve portion to provide a support shoulder for an outside peripheral casing.

6. An insert according to claim 1 wherein said intermediate space has a generally annular configuration.

7. An insert according to claim 1 wherein said insert is arranged coaxially with respect to the applicator member.

8. An insert according to claim 2 wherein the ring element is fixed to the peripheral sealing portion of the applicator member.

9. An insert according to claim 1 wherein the holding means is spaced from the ring element.

* * * * *